US010800158B2

(12) United States Patent
Domsch et al.

(10) Patent No.: US 10,800,158 B2
(45) Date of Patent: Oct. 13, 2020

(54) APPARATUS AND METHOD FOR ADJUSTING GRAPHIC ARTS DIE PLATE ON CARRIER

(71) Applicant: Universal Engraving, Inc., Overland Park, KS (US)

(72) Inventors: Eric A. Domsch, Olathe, TX (US); Larry R. Hutchison, Overland Park, TX (US); Todd M. Rima, Olathe, KS (US); Austin Scott Hutchison, Overland Park, TX (US)

(73) Assignee: Universal Engraving, Inc., Overland Park, KS (US)

( * ) Notice: Subject to any disclaimer, the term of this patent is extended or adjusted under 35 U.S.C. 154(b) by 191 days.

(21) Appl. No.: 16/110,683

(22) Filed: Aug. 23, 2018

(65) Prior Publication Data

US 2019/0061337 A1 Feb. 28, 2019

Related U.S. Application Data

(60) Provisional application No. 62/549,776, filed on Aug. 24, 2017.

(51) Int. Cl.
*B41F 16/00* (2006.01)
*B44B 5/02* (2006.01)

(52) U.S. Cl.
CPC ..... *B41F 16/0066* (2013.01); *B44B 5/026* (2013.01)

(58) Field of Classification Search
CPC ..... B41F 16/0066
USPC ..... 101/30
See application file for complete search history.

(56) References Cited

U.S. PATENT DOCUMENTS 509,075 A * 11/1893 Fietsch ..... B41F 27/04 101/385
724,116 A * 3/1903 Maley ..... B41F 27/04 101/385
4,510,728 A * 4/1985 Key ..... E04G 23/0207 52/514
5,474,438 A * 12/1995 Walker, Jr. ..... B29C 33/303 425/185
5,515,749 A * 5/1996 Sandford ..... B26D 7/2614 76/107.1
5,582,102 A * 12/1996 Holliday ..... B23Q 16/00 101/28
7,096,709 B2 8/2006 Hutchison et al.
(Continued)

FOREIGN PATENT DOCUMENTS

EP 2977197 1/2016
JP 5351699 11/2013

OTHER PUBLICATIONS

International Search Report and Written Opinion from PCT/US2018/047796 entitled: Apparatus and Method for Adjusting Graphic Arts Die Plate on Carrier (Jan. 2, 2019).

*Primary Examiner* — Anthony H Nguyen
(74) *Attorney, Agent, or Firm* — Hovey Williams LLP

(57) ABSTRACT

A graphic arts die assembly includes a die carrier plate, a die, and a die adjuster. The die is adjustably supported on the die carrier plate. The die presents an outer margin and an engraved surface within the outer margin. The die further presents an adjuster surface that extends transversely relative to the engraved surface. The die adjuster shiftably engages the adjuster surface, with shifting movement of the die adjuster causing relative movement between the die and the die carrier plate.

19 Claims, 8 Drawing Sheets

(56) References Cited

U.S. PATENT DOCUMENTS

| | | | | |
|---|---|---|---|---|
| 7,628,053 | B2 * | 12/2009 | Bermudez, III | B21D 37/14 101/389.1 |
| 2003/0167622 | A1 * | 9/2003 | Cook | B30B 15/026 29/525.11 |
| 2004/0204713 | A1 * | 10/2004 | Abdou | A61B 17/8004 606/71 |
| 2012/0186471 | A1 | 7/2012 | Hutchison et al. | |

* cited by examiner

APPARATUS AND METHOD FOR ADJUSTING GRAPHIC ARTS DIE PLATE ON CARRIER

RELATED APPLICATION

This application claims the benefit of U.S. Provisional Application Ser. No. 62/549,776, filed Aug. 24, 2017, entitled APPARATUS AND METHOD FOR ADJUSTING GRAPHIC ATS DIE PLATE ON CARRIER, which is hereby incorporated in its entirety by reference herein.

BACKGROUND

1. Field

The present invention relates generally to a graphic arts die assembly. More specifically, embodiments of the present invention concern a graphic arts die assembly that enables a die to be adjustably positioned on a die carrier plate.

2. Discussion of Prior Art

A graphic arts press commonly uses a graphic arts die assembly and a graphic arts counter assembly for embossing, debossing, and/or foil stamping of a substrate. Conventional press systems include a die assembly with a series of dies that are secured in registration with a series of counters provided by the counter assembly. In some prior art systems, dies are individually positioned on the chase such that the die mounting process involves an extensive setup time.

Other known systems have been developed to secure multiple dies in registration on a common plate to provide a die assembly. When securing the conventional die assembly on a chase, the dies (supported on the common plate) are mounted on the chase at the same time. It is generally understood that the position of each die on the common plate can be manually adjusted by a user to provide precise registration between the printed indicia and the dies. In particular, it is known to engage a hand tool (such as a screwdriver) in an opening in the common plate and pry the tool against one of the dies to move the die laterally along the common plate.

However, conventional die assemblies and the associated adjustment methods have deficiencies. For instance, using a hand tool to pry a die along the common plate can scratch, deform, or otherwise damage the die and/or the plate. It is also time consuming and difficult to precisely shift the die in multiple directions along the plate using a hand tool.

SUMMARY

The following brief summary is provided to indicate the nature of the subject matter disclosed herein. While certain aspects of the present invention are described below, the summary is not intended to limit the scope of the present invention.

Embodiments of the present invention provide a graphic arts die assembly that does not suffer from the problems and limitations of the prior art graphic arts die systems set forth above.

A first aspect of the present invention concerns a graphic arts die assembly that broadly includes a die carrier plate, a die, and a die adjuster. The die is adjustably supported on the die carrier plate. The die presents an outer margin and an engraved surface within the outer margin. The die further presents an adjuster surface positioned inboard of the outer margin and extending transversely relative to the engraved surface. The die adjuster shiftably engages the adjuster surface and is operably supported relative to the die carrier plate, with shifting movement of the die adjuster along the die causing relative movement between the die and the die carrier plate.

A second aspect of the present invention concerns a graphic arts die assembly that broadly includes a die carrier plate, a stud, a die, and a die adjuster. The stud is fixed to and projects from the die carrier plate. The die is adjustably supported on the die carrier plate. The die presents an outer margin and an engraved surface within the outer margin. The die further presents an adjuster surface extending transversely relative to the engraved surface. The die adjuster is removably and shiftably attached to the stud to shiftably engage the adjuster surface, with relative shifting of the die adjuster on the stud causing relative movement between the die and the die carrier plate.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Preferred embodiments of the invention are described in detail below with reference to the attached drawing figures, wherein:

FIG. 1 is a fragmentary upper perspective of a graphic arts die assembly constructed in accordance with a preferred embodiment of the present invention, showing a chase and a die plate assembly mounted on the chase, with the die plate assembly including a carrier plate, threaded studs fixed to the carrier plate, and multiple dies secured on the studs with threaded nuts, and wherein the dies present die holes that receive the studs and nuts;

Figure 8:
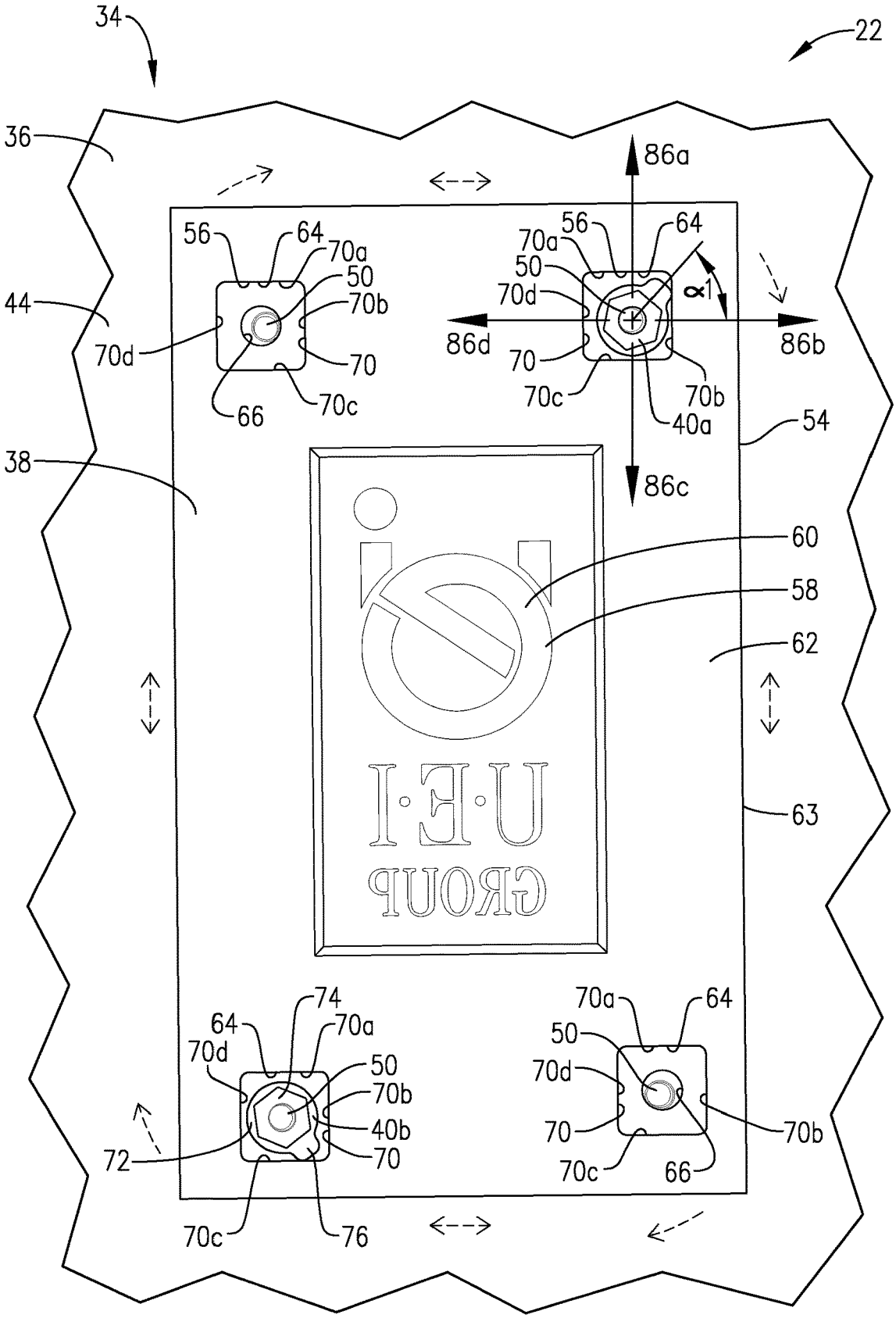
FIG. 8 is a fragmentary top view of the graphic arts die assembly shown in FIGS. 1-7, showing the die in a misaligned position, with the threaded nuts removed and the die adjusters mounted on respective studs.
Figure 9:
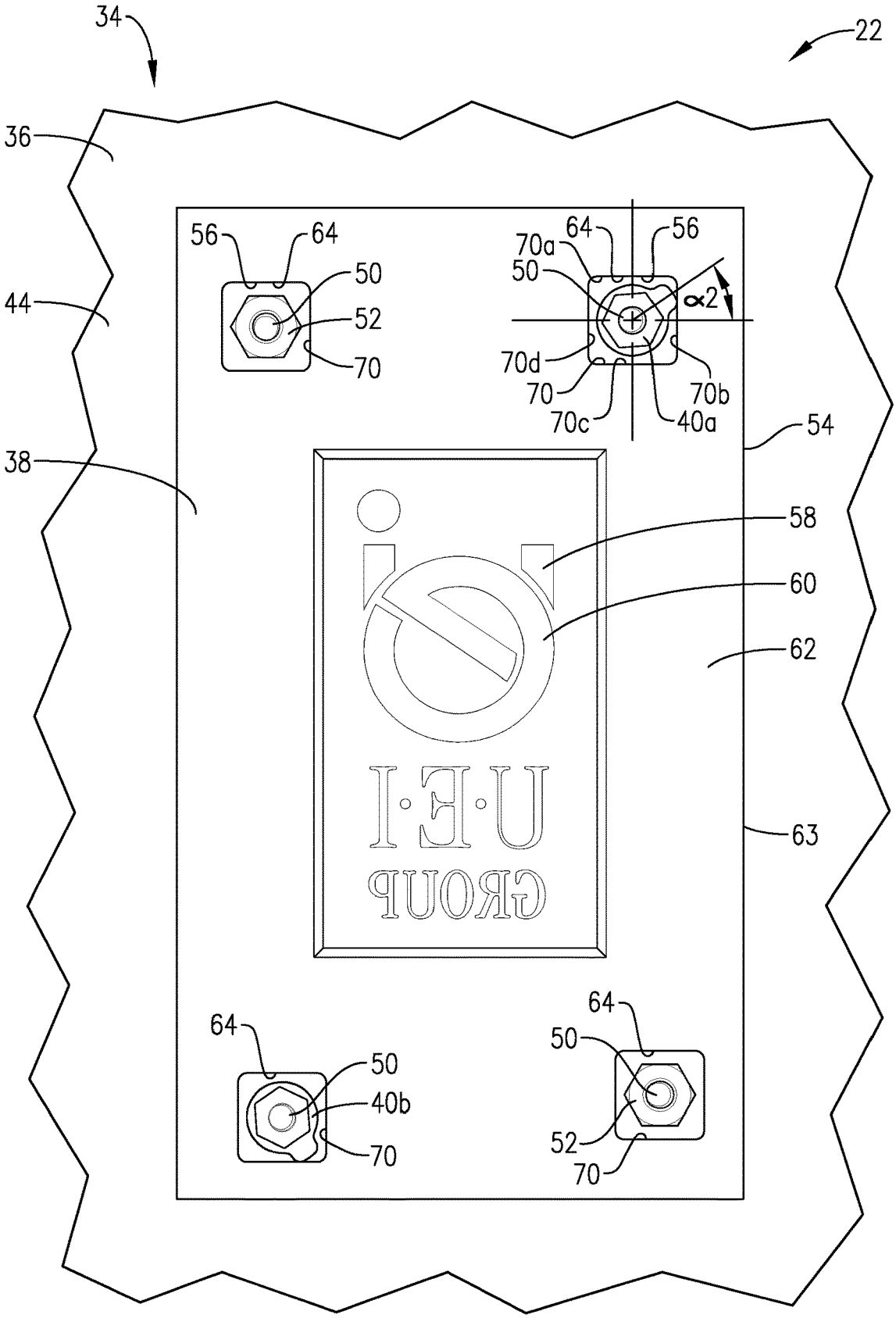
Figure 10:
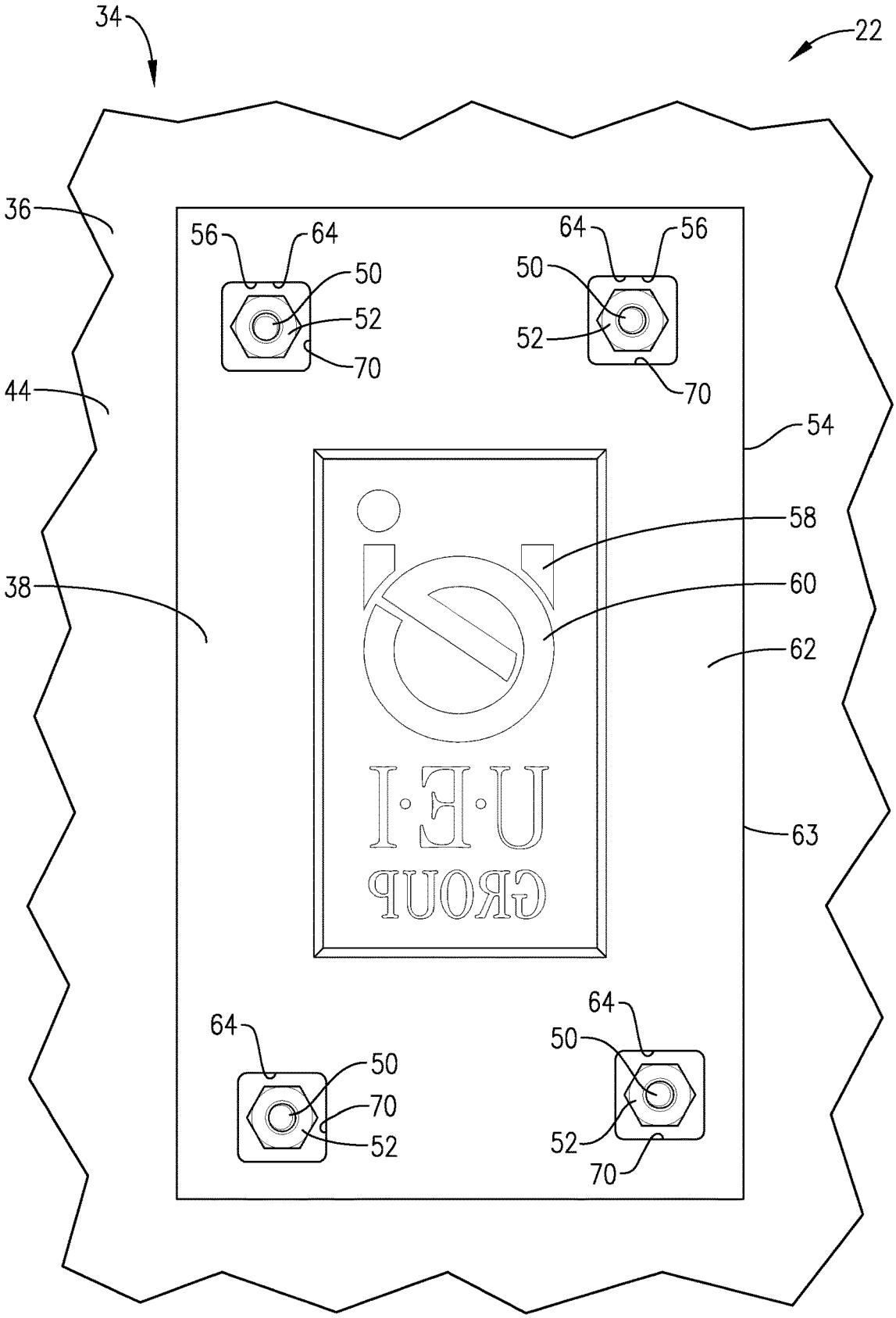

FIG. 9 is a fragmentary top view of the graphic arts die assembly similar to FIG. 8, but showing two (2) of the nuts mounted on corresponding studs, and the die adjusters rotated to shift the die into an aligned position; and FIG. 10 is a fragmentary top view of the graphic arts die assembly similar to FIG. 9, but showing the die adjuster removed and two (2) of the nuts being mounted on corresponding studs to secure the die in the aligned position.

The drawing figures do not limit the present invention to the specific embodiments disclosed and described herein. The drawings are not necessarily to scale, emphasis instead being placed upon clearly illustrating the principles of the preferred embodiment.

DETAILED DESCRIPTION OF THE PREFERRED EMBODIMENTS

Figure 3:
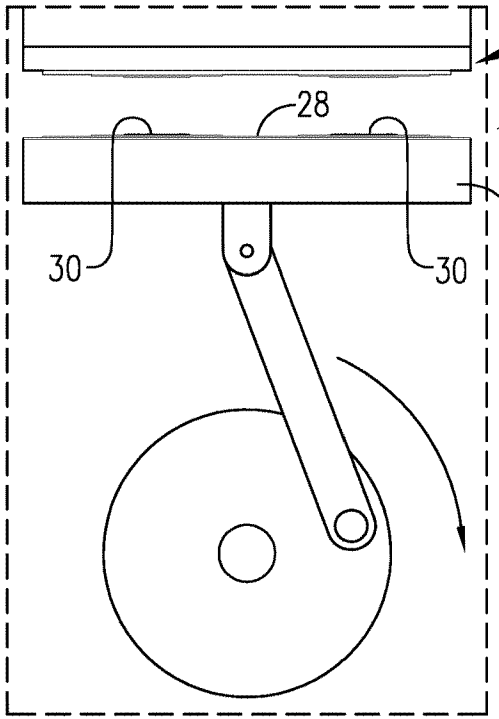
FIG. 3 is a schematic view of a press including the graphic arts die assembly shown in FIGS. 1 and 2 and a graphic arts counter structure mounted on a reciprocating support structure.

Turning initially to FIG. 3, a flat bed press 20 is operable to perform hot foil stamping, embossing, or debossing (or any combination thereof) of a substrate. As will be described in greater detail, a graphic arts die assembly 22 is configured to be setup quickly and efficiently for use as part of the press 20. During setup, the construction of the graphic arts die assembly 22 enables fine adjustment of die position along a lateral direction. The press 20 preferably includes the graphic arts die assembly 22, a graphic arts counter structure 24, and a reciprocating support structure 26.

The illustrated press 20 can comprise either a sheet fed press or a web press without departing from the scope of the present invention. The graphic arts counter structure 24 is mounted to the support structure 26 for reciprocating movement relative to the graphic arts die assembly 22.

The graphic arts counter structure 24 is operable to reciprocate into and out of engagement with the graphic arts die assembly 22 to provide a substrate with hot foil stamping, embossing, debossing, or any combination thereof. The graphic arts counter structure 24 preferably includes a carrier plate 28 and a plurality of counters 30 mounted on the carrier plate 28. Details of one preferred embodiment of a graphic arts counter structure with multiple counters is disclosed in U.S. Application No. 62/500,978, filed May 3, 2017, entitled GRAPHIC ARTS COUNTER ASSEMBLY, which is attached hereto as Appendix A. Consistent with the principles of the present invention, the counter structure 24 can be variously configured to provide foil stamping, embossing, debossing, or any combination thereof.

Turning to FIGS. 1-7, the graphic arts die assembly 22 preferably provides a series of dies for hot foil stamping, embossing, debossing, or any combination thereof. The depicted die assembly 22 includes a chase 32 and a die plate assembly 34 removably attached to the chase 32. The die plate assembly 34 preferably includes a die carrier plate 36, graphic arts dies 38, and die adjusters 40*a,b*. The die plate assembly 34 also preferably includes threaded studs 50 and threaded nuts 52, as described below.

Again, the graphic arts die assembly 22 is preferably configured for use with a flat bed press. Consequently, the illustrated die carrier plate 36 and dies 38 preferably have a generally flat, planar construction. Similarly, the chase 32 preferably has relatively planar surfaces for mounting the chase 32 on the press and for supporting the die plate assembly 34. However, in at least some alternative embodiments, the graphic arts die assembly could be configured for use on a web-fed press (i.e., a web press).

The illustrated chase 32 comprises a conventional honeycomb chase structure. Preferred details of a suitable honeycomb chase are disclosed in U.S. Pat. No. 7,096,709, issued Aug. 29, 2006, entitled GRAPHIC ARTS DIE AND SUPPORT PLATE ASSEMBLY, which is attached as Appendix B and is hereby incorporated in its entirety by reference herein.

Although the depicted chase 32 is preferred, various chase configurations can be used in combination with the die plate assembly 34 without departing from the scope of the present invention. For example, the die plate assembly 34 could be removably secured to a magnetic chase. Preferred features of a magnetic chase assembly are disclosed in U.S. Application No. 62/485,680, filed Apr. 14, 2017, entitled MAGNETIC CHASE AND GRAPHIC ARTS DIE PLATE ASSEMBLY, which is attached hereto as Appendix C.

The die carrier plate 36 is configured to support multiple dies 38 on the chase 32 in a predetermined arrangement relative to one another where the dies 38 are aligned with corresponding counters 30. As will be described, the die carrier plate 36 and dies 38 are assembled to form a die structure that can be removed from the chase 32 and subsequently reinstalled in alignment with the counters 30. Although the illustrated die plate assembly 34 is particularly useful for mounting multiple dies relative to the chase 32, it is within the ambit of the present invention where the die plate assembly 34 includes a single die.

As noted above, the die carrier plate 36 and dies 38 preferably have a flat, planar construction for use with a flat bed press (whether the flat bed press comprises a sheet-fed press or a web-fed press). For some aspects of the present invention, the die carrier plate and dies could be curved for mounting and use as part of a web-fed press (e.g., where the web-fed press has a rotary graphic arts mechanism). For instance, the carrier plate and dies could be curved for mounting onto a cylindrical rotary chase. In such alternative embodiments, it will be appreciated that the die carrier plate and dies are curved to conform closely to the cylindrical outer mounting surface of the rotary chase, which facilitates precise mounting to the chase. In at least some alternative embodiments, the carrier plate and/or dies could be constructed and assembled together in a relatively flat configuration and subsequently formed to assume the curved shape suitable for mounting on the rotary chase.

Figure 1:
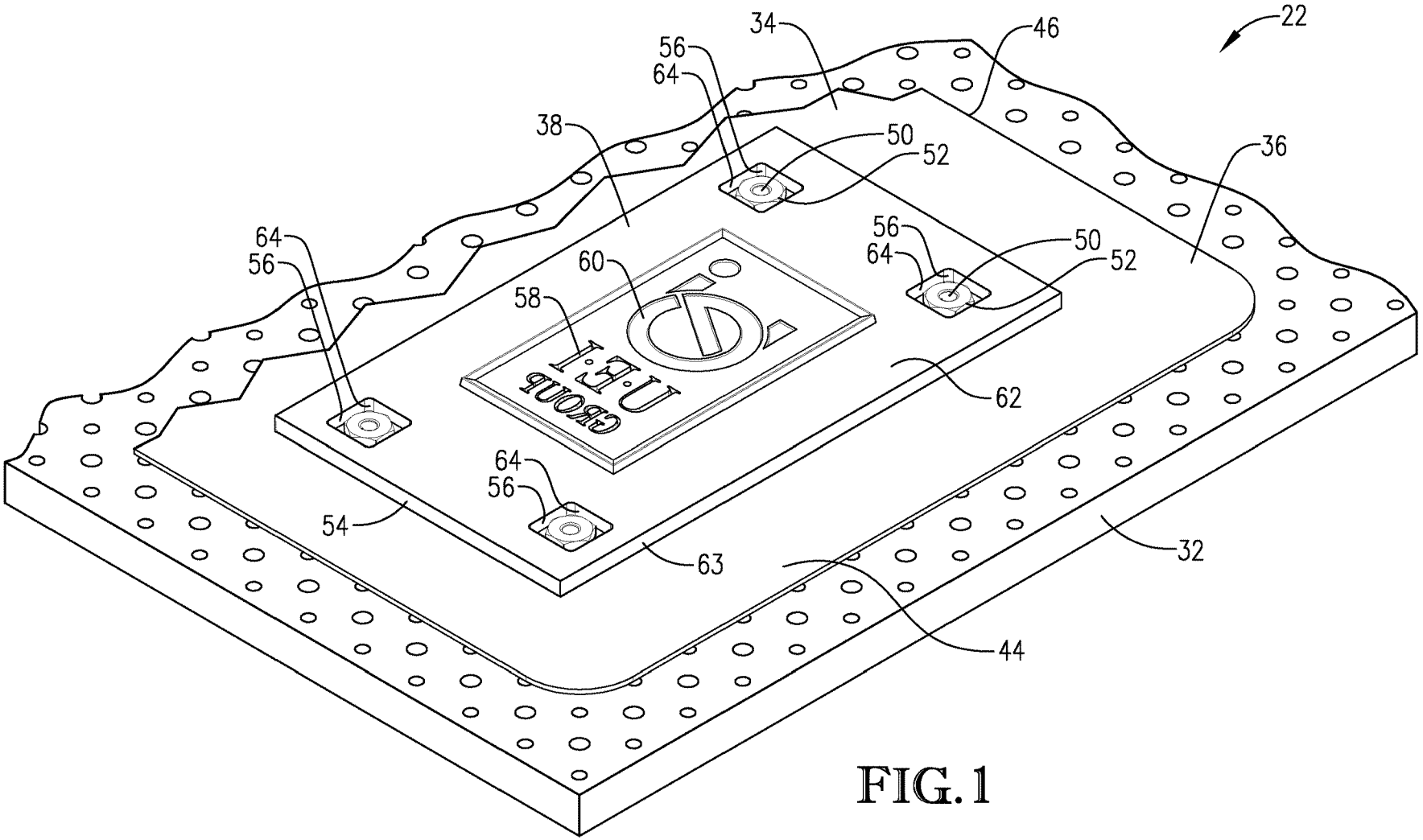
Figure 2:
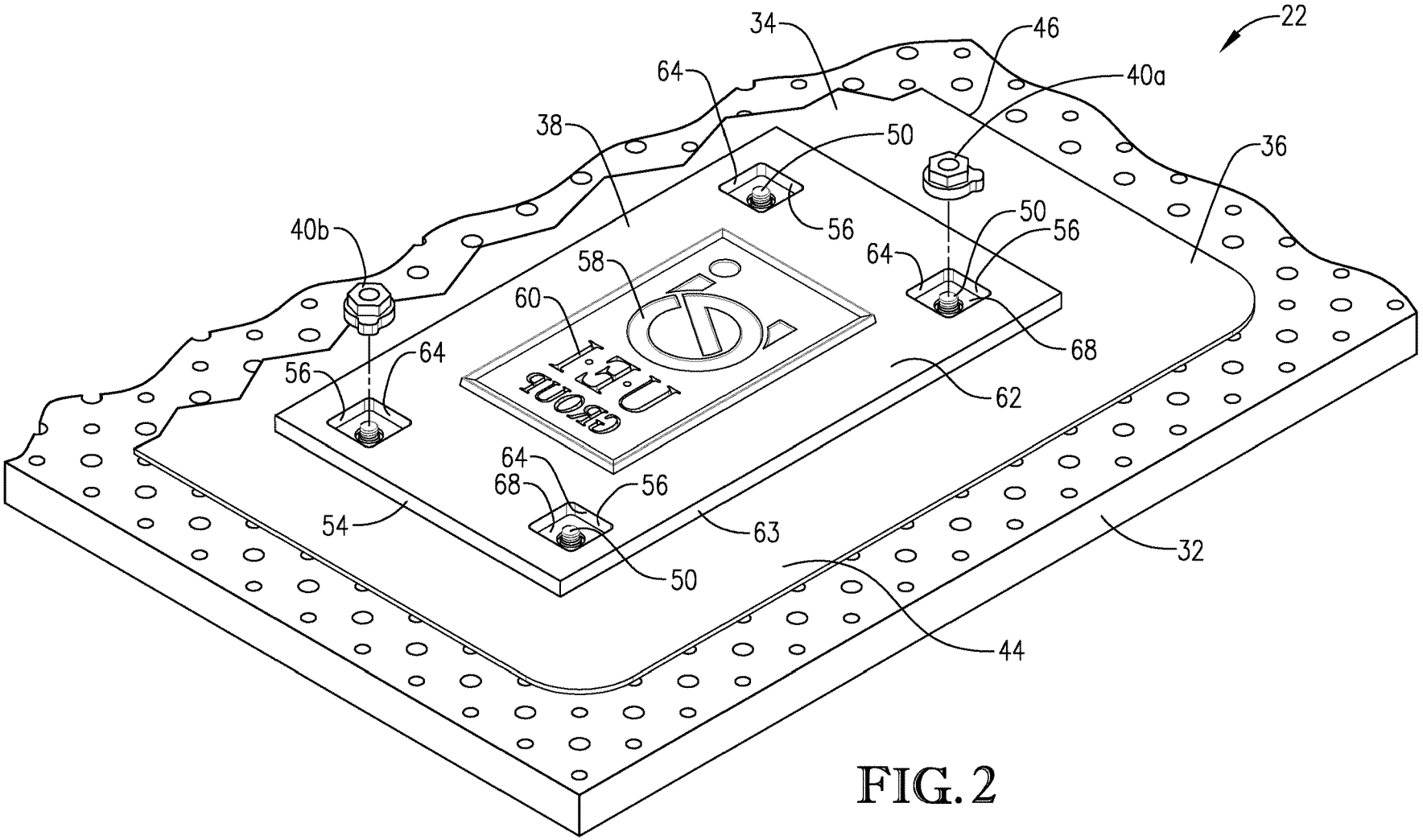
FIG. 2 is a fragmentary upper perspective of the graphic arts die assembly similar to FIG. 1, but showing the nuts removed from the die holes to permit location of the die adjusters within the die holes and on the studs.

The depicted die carrier plate 36 presents a chase-engaging surface 42, a die-receiving surface 44, and a perimeter edge 46 (see FIGS. 2 and 3). The die carrier plate 36 is configured to be removably attached to the dies 38 and to support the dies 38 on the surface 44.

The illustrated die carrier plate 36 is removably secured to the chase 32 with multiple toggle clamps (not shown). However, it is also within the ambit of the present invention where the die carrier plate 36 is alternatively secured to the chase 32. In one such alternative embodiment, the die carrier plate 36 is magnetically secured on the chase 32. Preferred details of a magnetic mounting arrangement are disclosed in the above-referenced '680 application (see Appendix C).

The die plate assembly 34 also preferably includes a plurality of threaded studs 50 secured to the die carrier plate 36 so that the studs 50 project from the surface 44. Although the depicted studs 50 are preferably welded to the die carrier plate 36, the studs 50 could be alternatively fixed to the die carrier plate 36 without departing from the scope of the present invention. For instance, one or more studs could be brazed or chemically bonded to the die carrier plate 36. Furthermore, one or more studs could be press fit within complemental openings presented by the die carrier plate 36.

Figure 4:
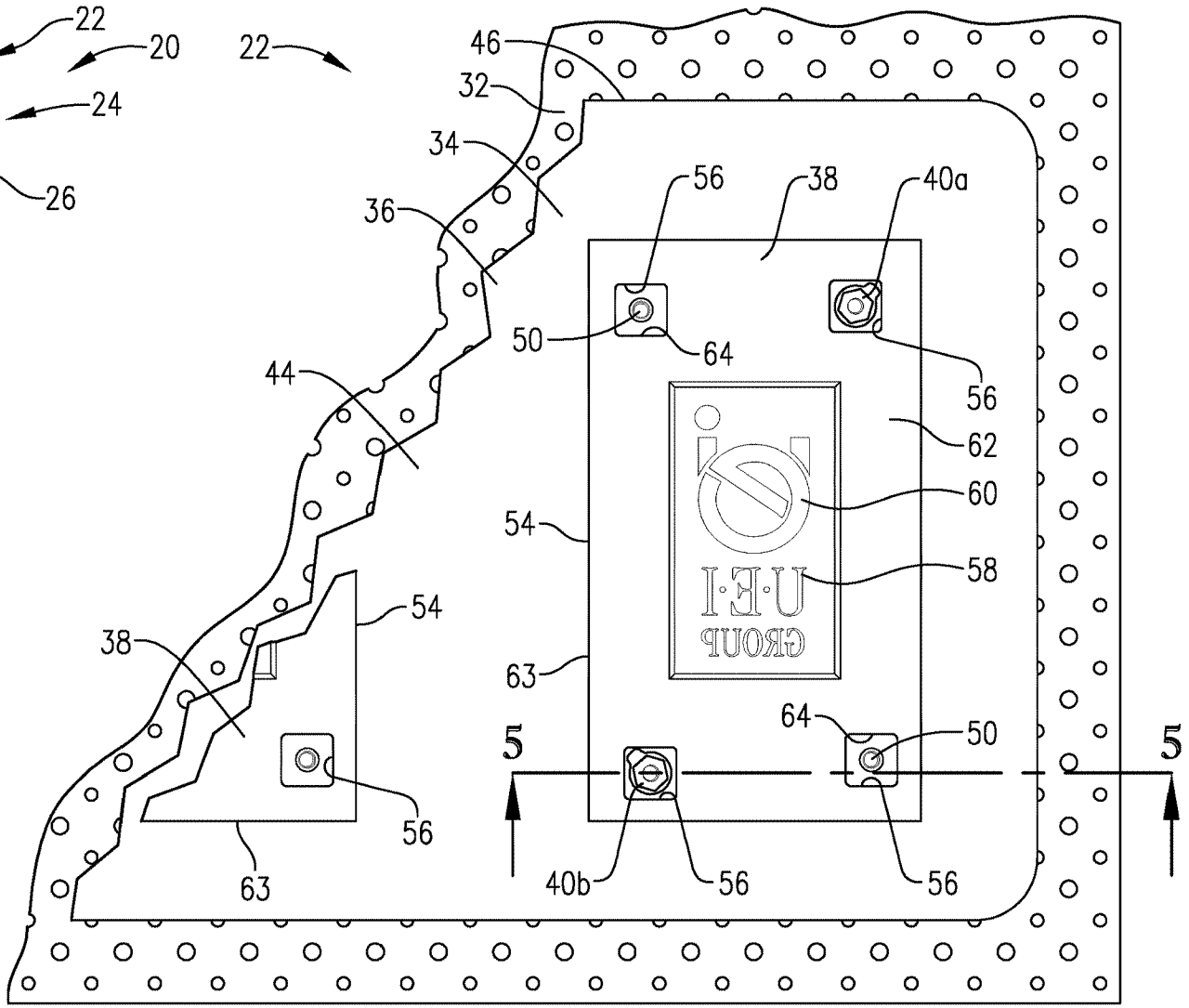
FIG. 4 is a fragmentary top view of the graphic arts die assembly shown in FIGS. 1-3, showing the die adjusters mounted on corresponding studs.
Figure 5:
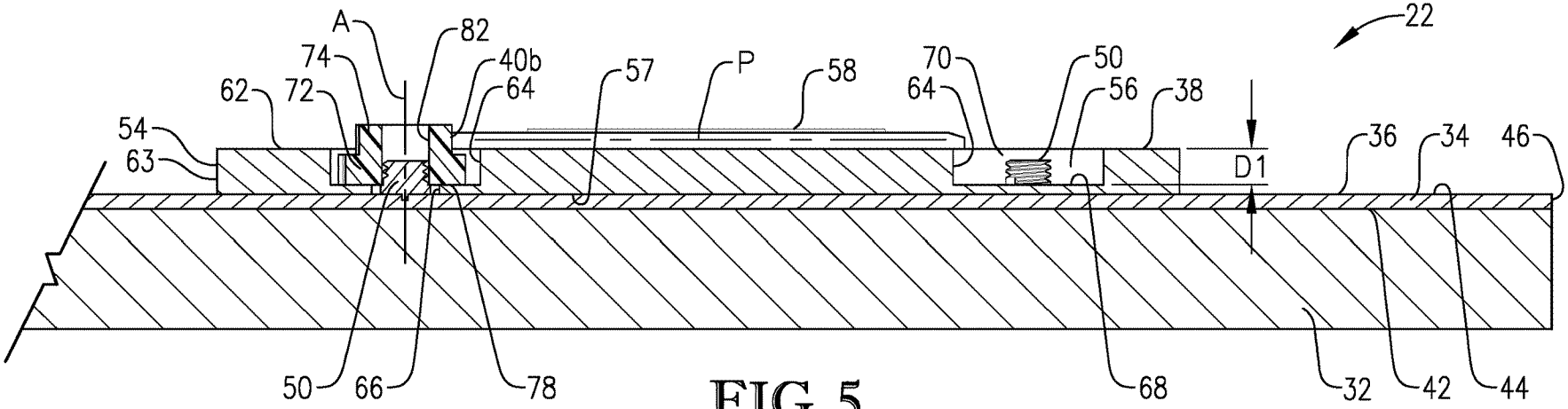
FIG. 5 is a cross section of the graphic arts die assembly taken along line 5-5 in FIG. 4, showing one of the die adjusters rotatably received on a respective stud.

The die plate assembly 34 further includes a plurality of threaded nuts 52 removably threaded onto the studs 50 (see FIGS. 4 and 5). The studs 50 and nuts 52 are configured to adjustably secure the graphic arts dies 38 on the die carrier plate 36. Consistent with the principles of the present invention, an alternative die carrier plate could also be provided. Features of alternative die carrier plate structures are disclosed in the above-incorporated '709 patent.

In the illustrated embodiment, the studs 50 and nuts 52 are preferably undersized relative to the holes in the dies 38 to permit fine adjustment of the lateral positioning of each die 38 relative to the die carrier plate 36. When multiple dies 38 are mounted onto the common die carrier plate 36, the studs 50 and nuts 52 permit adjustable lateral positioning of the dies 38 relative to one another.

The principles of the present invention are applicable where dies are alternatively mounted on a common carrier plate. For instance, although not depicted, it will be appreciated that the die carrier plate 36 could support multiple dies in a fixed relationship relative to one another in addition to adjustably supported dies. Other alternative embodiments of multiple dies supported by a common die carrier plate are disclosed in the above-incorporated '709 patent.

Still referring to FIGS. 1-7, each graphic arts die 38 preferably comprises an engraved graphic arts die for hot foil stamping, embossing, debossing, or any combination thereof, although the principles of the present invention are also applicable where the graphic arts die 38 is used in connection with a die-cutting device. As used herein, the term "engraved" refers to die engraving by photo-etching, manual engraving, or machining (e.g., conventional milling, laser machining, or computer numerical control (CNC) milling).

The graphic arts die 38 preferably presents a machined edge 54, die holes 56, a generally planar bottom surface 57, and an engraved surface 58 (see FIGS. 4 and 5). The edge 54 is machined to preferably comprise a substantially vertical edge surface. That is, the illustrated edge 54 is substantially devoid of a bevel, with opposite side portions of the edge 54 being substantially parallel to one another. In the illustrated embodiment, it will also be appreciated that the edge 54 is preferably transverse to (and, more preferably, substantially perpendicular to) the bottom surface 57. Furthermore, the edge 54 is preferably transverse to (and, more preferably, substantially perpendicular to) a nominal plane of the engraved surface 58. However, according to certain aspects of the present invention, the edge 54 or a portion thereof may be beveled or otherwise lie outside the vertical plane (e.g., where the edge is configured to be engaged by a toggle device), without departing from the spirit of the present invention.

The engraved surface 58 is preferably formed by engraving the graphic arts die 38. The engraved surface 58 defines an image indicia 60. The illustrated graphic arts die 38 also presents a generally planar background surface 62 that surrounds the engraved surface 58.

The engraved surface 58 of the illustrated embodiment preferably defines a nominal engraved surface plane P (see FIG. 5) that is generally parallel and offset relative to the bottom surface 57. It will be appreciated that the engraved surface 58 may extend below and above the nominal engraved surface plane P such that the plane intersects the indicia. That is, the nominal plane P generally coincides with a flat surface that is spaced equally between the lowermost median point of the engraved surface 58 and the uppermost median point of the engraved surface.

However, in various alternative embodiments, the nominal engraved surface plane could be arranged in a non-parallel relationship to the bottom surface 57. As one example, if the die assembly is alternatively configured for use in a web-fed press, the engraved surface (not shown) could have a cylindrical shape and present a nominal engraved surface circle that is spaced slightly radially outward from the cylindrically-shaped carrier plate (also not shown).

As discussed above, various conventional engraving techniques, including those disclosed in the above-incorporated '709 patent, can be used to form the engraved surface 58. However, the principles of the present invention are applicable where the surface 58 is alternatively constructed to provide the indicia 60. While the illustrated surface 58 is provided for embossing, the graphic arts die 38 could alternatively have features for foil stamping, embossing, debossing, or any combination thereof.

In the depicted embodiment, the edge 54 at least partly defines an outer margin 63 of the die 38. The outer margin 63 preferably surrounds the engraved surface 58 and the background surface 62. In some alternative embodiments, the engraved surface and/or the background surface could be alternatively positioned relative to the outer margin of the die. For instance, at least part of the engraved surface could extend up to the machined edge of the die. It will also be appreciated that part of the outer margin could be positioned somewhat inboard relative to the engraved surface and/or the background surface (e.g., where the die has one or more notches that extend inboard from outboard parts of the machined edge).

The disclosed edge is generally not engaged by an adjuster device to shift the die relative to the carrier plate. However, for some aspects of the present invention, the edge could be used for die adjustment.

Each graphic arts die 38 preferably is formed of a non-ferrous metal and, more preferably, is formed of brass alloy. However, it is also within the scope of the present invention where the graphic arts die 38 is formed wholly or partly of steel, magnesium, zinc, polymer, copper alloy, or a composite material, such as fiberglass.

Figure 6:
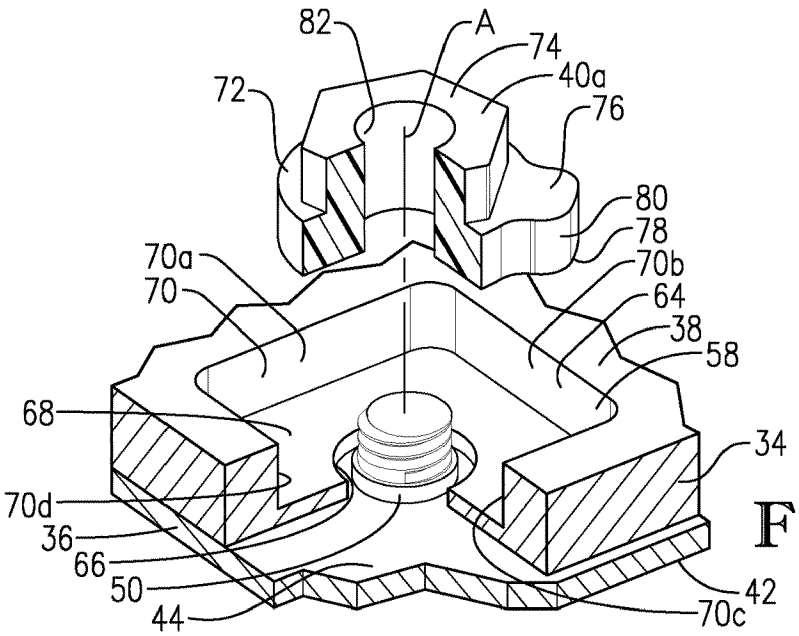
FIG. 6 is an enlarged fragmentary perspective of the graphic arts die assembly shown in FIGS. 1-5, showing one of the die adjusters located above a corresponding stud.
Figure 7:
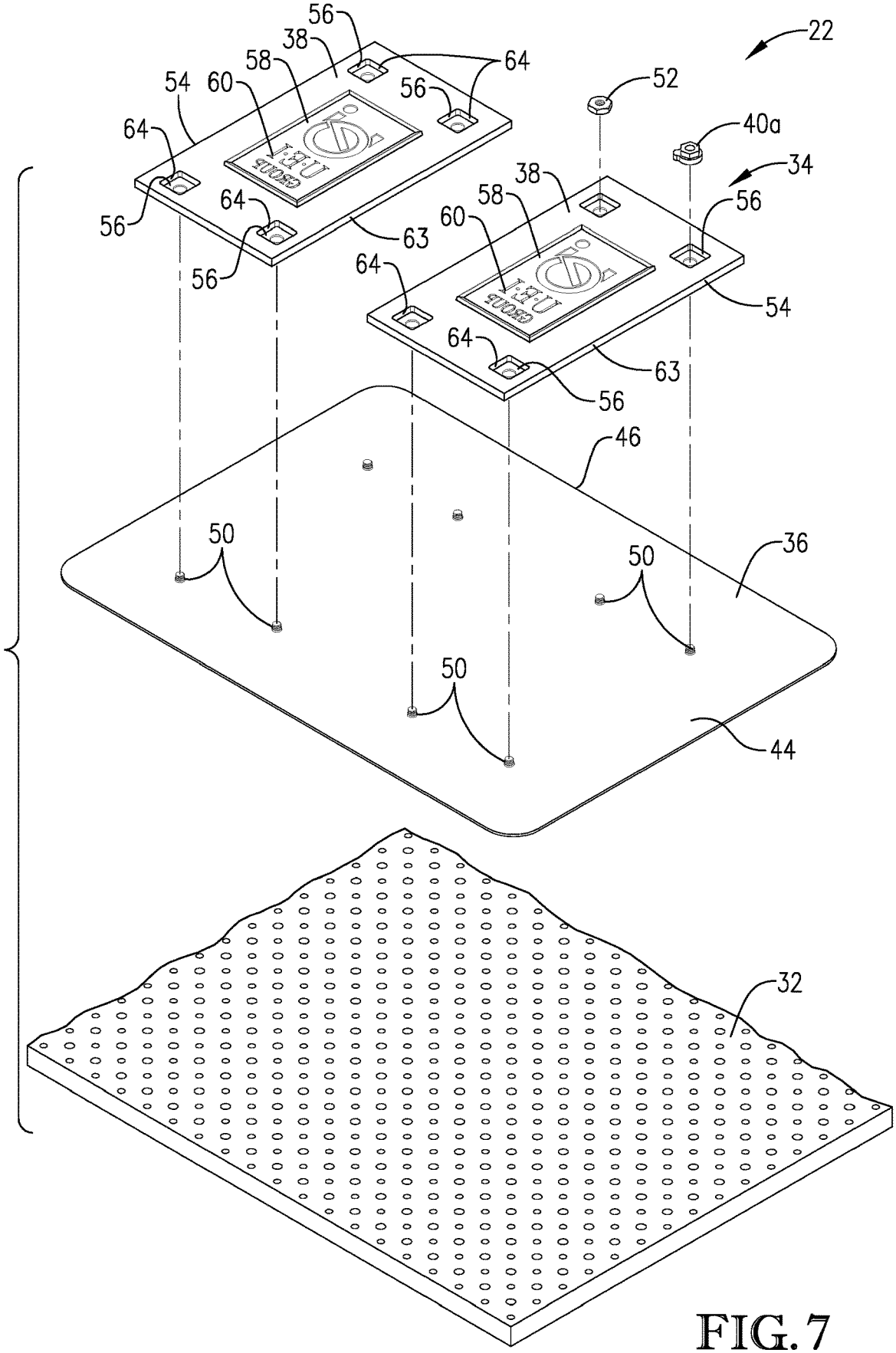
FIG. 7 is a fragmentary exploded perspective of the graphic arts die assembly shown in FIGS. 1-6.

Turning to FIGS. 5, 6, and 8, each die hole 56 preferably extends completely through the die 38 and is cooperatively defined by a socket 64 and a bore 66. The illustrated socket 64 is defined by a generally planar recessed face 68 and an endless shoulder 70 with four (4) shoulder sections 70*a-d* (see FIGS. 6 and 8). The socket 64 presents a socket depth dimension D1 (see FIG. 5) measured between the background surface 62 and the recessed face 68.

The recessed face 68 is preferably flat to flushly engage the underside of the corresponding nut 52. In the illustrated embodiment, the recessed face 68 is at least substantially parallel to the background surface 62. The shoulder sections 70*a-d* are preferably similar in shape and size such that the socket 64 is square-shaped. However, alternative socket configurations are within the ambit of the present invention, as will be described. Further, the bore 66 is preferably centered within the socket 64, although alternative locations are within the ambit of the present invention.

The die holes 56 are configured to receive the studs 50 and nuts 52. Preferably, the nuts 52 are received by the holes 56 so that the nuts 52 do not project out of the die holes 56 and beyond the background surface 62. The die holes 56 are preferably located about and spaced from the indicia 60. Additional features of a method for manufacturing the graphic arts die 38 to provide relative positioning and alignment between die holes 56 and indicia 60 are disclosed in the above-incorporated '709 patent.

As will be discussed, the die holes 56 are also preferably configured to receive and be engaged by one of the die adjusters 40. It will also be appreciated that one or more die holes could be configured to receive a die adjuster 40 but not configured to receive one of the studs 50 or nuts 52. In one alternative embodiment, the die could include die holes to receive corresponding studs and nuts, while including one or more additional die holes spaced from the edge 54 to receive one or more corresponding die adjusters. As an example, studs dedicated for use with only an adjuster may be smooth and not threaded.

The shoulder 70 of each die hole 56 preferably provides an adjuster surface that is shiftably engaged by the die adjuster 40. In the depicted embodiment, the adjuster surface is preferably transverse to (i.e., intersecting and not parallel to) the engraved surface 58. In the illustrated flat embodiment, it may also be said that the adjuster surface 70 is substantially perpendicular to the nominal engraved surface plane P. If the principles of the present invention are applied to a rotary die assembly configuration (not shown), the adjuster surface 70 is preferably radially oriented (possibly after the die assembly has been formed into a cylindrical shape).

The shoulder 70 preferably defines a generally square profile shape of the socket 64. As will be described, the square socket profile permits the die adjusters 40 to shift the die 38 by engaging the shoulder 70, which acts as a cam follower. It will also be appreciated that the shoulder 70 could have an alternative polygonal or eccentric (relative to the stud) shape that permits camming engagement with one of the die adjusters 40, consistent with the scope of the present invention.

For some aspects of the present invention, the shoulder could also have a circular profile. For instance, the shoulder could have a circular shape that is concentrically arranged with respect to the bore 66 (i.e., where the socket 64 and bore 66 are coaxial). However, in yet another alternative embodiment, the socket 64 and bore 66 could be eccentrically arranged.

The die holes 56 and the corresponding adjuster surfaces are preferably positioned inboard of the outer margin of the die 38. However, in some alternative embodiments, the adjuster surfaces could extend up to the outer margin and/or be provided by the outer margin.

Again, the studs 50 and nuts 52 serve to secure the graphic arts die 38 onto the die carrier plate 36. The studs 50 and nuts 52 are preferably undersized relative to the bores 66 and sockets 64, respectively, to permit fine adjustment of the lateral positioning of the die 38 relative to the die carrier plate 36.

The nuts 52 are configured to be threaded on the studs 50 into and out of full frictional engagement with the recessed faces 68 of the dies 38. In full frictional engagement, the nuts 52 cooperatively restrict lateral die movement relative to the die carrier plate 36, including lateral die movement caused by rotation of one or more die adjusters 40. As will be explained, the nuts 52 are preferably secured in full friction engagement with the dies 38 when the dies are in an aligned position (see FIG. 9) to restrict die movement out of the aligned position.

As also described below, the nuts 52 can be arranged in partial frictional engagement with the die 38, where die movement is frictionally restricted but permitted by rotating at least one die adjuster 40 (e.g., where the die adjusters 40 cooperatively move the die 38 from a misaligned position (see FIG. 8) to the aligned position (see FIG. 9)).

Referring again to FIGS. 5, 6, and 8, each die adjuster 40 may be used to selectively move a die 38 on the carrier plate 36 to precisely adjust the die location. Each of the depicted die adjusters 40 preferably has a unitary construction and includes a generally cylindrical body 72, a faceted head 74, and an exterior lobe 76 projecting in a laterally outboard direction from the body 72.

The head 74 preferably presents a hexagonal shape such that the die adjuster 40 has the general shape of a hexagonal nut and is configured to be engaged by any of various conventional wrenches (not shown). In the usual manner, a wrench can engage the head 74 to rotate the die adjuster 40 about an axis A (see FIGS. 5 and 6) of the stud 50. However, the die adjusters 40 could be alternatively configured for engagement with an alternative fastening tool, such as a screwdriver or Allen wrench, to rotate the die adjusters 40. For some aspects of the present invention, the head 74 could be mounted directly to a tool handle, such that the tool is manually controlled to effect die adjustment.

The body 72 and lobe 76 cooperatively define a bottom surface 78 and an endless cam surface 80 (see FIG. 6). The bottom surface 78 is configured to engage and rest against the recessed face 68. As will be discussed, the cam surface 80 can be selectively brought into and out of sliding engagement with the shoulder 70 (i.e., the adjuster surface). Each die adjuster 40 also preferably presents a smooth bore 82 extending axially through the body 72 and the head 74.

In the illustrated embodiment, each die adjuster 40 is rotatably supported relative to the die carrier plate 36 and is configured to shift the die 38 from the misaligned position (e.g., see FIG. 8) to the aligned position (e.g., see FIG. 9). The misaligned position corresponds to a die position on the carrier plate 36 where the die 38 is not aligned with a substrate (not shown). For the illustrated embodiment, the image indicia 60 is not aligned with printed image indicia (not shown) of the substrate when the die 38 is in the misaligned position. The image indicia 60 may also be misaligned with respect to indicia and/or other features of a respective one of the counters 30 when the die 38 is in the misaligned position.

The aligned position corresponds to a die position on the carrier plate 36 where the die 38 is aligned with the substrate. In the illustrated embodiment, the image indicia 60 is aligned with printed image indicia of the substrate when the die 38 is in the aligned position.

Each die adjuster 40 is operable to be removably received on any of the studs 50. Preferably, the stud 50 and die adjuster 40 cooperatively provide an interior rotation interface 84 (see FIG. 5) that permits the die adjuster 40 to rotate smoothly relative to the stud 50 about the stud axis A.

The die adjuster 40 is mounted on one of the studs 50 by inserting the stud 50 into the bore 82 and resting the die adjuster 40 in sliding engagement with the recessed face 68 (see FIG. 5). In general, the body 72 and head 74 are preferably spaced from the shoulder 70. When placing the die adjuster 40 into the socket 64, if the lobe 76 of the die adjuster 40 extends laterally beyond the shoulder 70, the die adjuster 40 may simply be rotated about the stud axis A so that the lobe 76 can be positioned entirely within the socket 64.

In the illustrated embodiment, the die adjusters 40 are rotatable to engage any of the four shoulder sections 70*a-d*. For instance, die adjuster 40*a* is configured to rotate clockwise from a first angular position, associated with angle $\alpha 1$ (see FIG. 8), to a second angular position, associated with angle $\alpha 2$ (see FIG. 9) so that the lobe 76 slidably engages the shoulder section 70*b* and moves the die 38. Similarly, die adjuster 40*b* is configured to rotate clockwise from a first angular position (see FIG. 8) to a second angular position (see FIG. 9) so that the lobe 76 slidably engages the shoulder section 70*c* of the respective socket 64 to move the die 38.

As the die adjuster 40 slidably engages with one of the shoulder sections 70*a-d*, the die 38 generally moves in a corresponding die movement direction 86*a-d* (see FIG. 8) normal to the respective shoulder section 70*a-d*. Thus, the shoulder sections 70*a-d* are associated with corresponding die movement directions 86*a-d* that are different from each other.

For instance, in the depicted embodiment, rotation of die adjuster 40*a* from the first position to the second position causes the respective lobe 76 to slidably engage the shoulder section 70*b* and move the die along the direction 86*b*. Similarly, rotation of die adjuster 40*b* from the first position to the second position causes the respective lobe 76 to slidably engage the shoulder section 70*c* and move the die along the direction 86*c*.

The die adjusters 40*a*, 40*b* are rotatable to cooperatively produce corresponding die movement from the misaligned position to the aligned position. It will be understood that movement of the die adjusters 40*a*, 40*b* could be done in a series of steps or could be done at the same time. Although the illustrated embodiment includes a pair of die adjusters 40, it is within the scope of the present invention where a single die adjuster 40 is used (or more than two (2) adjusters are used) to provide the described die movements (or other suitable die movement).

In some situations, it will be appreciated that one or more alternative die adjuster movements may be required to appropriately move and thereby align the die 38. For instance, one or both of the die adjusters 40 could be moved counterclockwise relative to the die 38. Although die movement in two of the directions 86 is illustrated, it is also within the ambit of the present invention where die movement is required in only one direction 86 to produce die alignment.

The depicted die assembly 22 is preferably configured so that the die adjuster 40 can be located in any one of the die holes 56, used to move the die 38 laterally, and then removed to permit installation of a nut 52 on the corresponding stud 50. However, as noted previously, one or more die holes could be configured to receive a die adjuster 40 but not configured to receive one of the studs 50 or nuts 52.

Turning to FIGS. 8 and 9, the die adjusters 40 are configured to shift the die 38 from the misaligned position (e.g., see FIG. 8) to the aligned position (e.g., see FIG. 9). In the misaligned position, the die adjusters 40 are inserted into a pair of respective sockets 64. Nuts 52 are mounted on a pair of studs 50 in the other two (2) sockets 64.

Preferably, the pair of nuts 52 are brought into partial frictional engagement with the respective recessed faces 68 where the nuts 52 and the carrier plate 36 permit lateral sliding of the die 38 relative to the carrier plate 36 but also frictionally resist lateral sliding of the die 38 (i.e., the nuts are not fully tightened). In this manner, the die 38 is not loosely supported on the carrier plate 36, but adjustment of the die position using the adjusters 40 is still permitted. It will be appreciated that each die adjuster 40 can be inserted into the respective socket 64 either before or after the nuts 52 are mounted on the studs 50 in the other sockets 64.

With the nuts 52 being in partial frictional engagement, the die adjusters 40 are preferably rotated from the first position to the second position to cooperatively produce corresponding die movement from the misaligned position to the aligned position.

While the depicted die adjuster 40 has a preferred configuration, the principles of the present invention are equally applicable to various alternative die adjuster configurations. For instance, the die adjuster could have one or more alternative exterior lobes to engage the shoulder of the socket.

It is also within the ambit of the present invention where the die adjuster has a circular outer edge. For example, the die adjuster could present a circular outer edge arranged eccentrically relative to the bore.

It will also be appreciated that the die and die adjuster could cooperatively provide a continuous exterior rotation interface that permits smooth rotation of the die adjuster about an axis of the socket. That is, the outer edge of the die adjuster could have a circular shape that is complementally received by a circular socket. In such an embodiment, the bore 66 of the die hole 56 can be eccentrically located relative to the outer edge of the die adjuster so that rotation of the die adjuster causes lateral die movement relative to the carrier plate 36.

Although the die adjuster 40 preferably moves the die 38 by engaging one of the studs 50, it is consistent with the scope of the present invention where the adjuster 40 is configured to engage another feature of the carrier plate. In one such alternative embodiment, the carrier plate could present one or more carrier plate openings that are selectively aligned with one of the die holes to permit engagement of a die adjuster with both the die hole and the carrier plate opening. For instance, the alternative die adjuster could include a body and a stud that are attached to one another. When the alternative die adjuster is installed in the die and carrier plate, the body is rotatably received by one of the die holes, and the stud is rotatably received by a corresponding one of the carrier plate openings. The die adjuster can then be rotated, with the stud being rotated within the carrier plate opening and the head rotated to slidably engage the shoulder of the socket, to cause lateral die movement.

While the die adjuster 40 and various alternative adjusters rotate about an upright axis to cause lateral die movement relative to the carrier plate 36, the principles of the present invention are equally applicable to a die adjuster that shifts in an alternative direction.

In one alternative configuration, the adjuster could comprise a cam that is located in a die hole and slides in a linear direction to cause die movement transverse to the linear direction. In another alternative configuration, the die adjuster could include a rotating element (such as a gear or friction wheel) that engages the carrier plate 36 and rotates about a lateral axis to move the die along the carrier plate 36.

The depicted die adjuster 40 has the general shape of a hexagonal nut, which permits the die adjuster 40 to be engaged by any of various conventional wrenches. As discussed above, the die adjuster 40 could be alternatively configured for engagement with an alternative fastening tool, such as a screwdriver or Allen wrench. Furthermore, it is also within the ambit of the present invention where the die adjuster 40 is provided as an integral part of a tool (such as a hand-operated tool). For instance, the die adjuster could comprise a hand-held wrench.

To provide a fast and convenient process of aligning the dies 38, the die adjusters 40 are preferably used to engage and shift the dies 38. In some alternative embodiments, one or more similar adjuster elements could be used to engage and shift counters along carrier plate 28 to provide alignment between a counter and a respective die 38.

In use, the die plate assembly 34 is operable to be quickly and conveniently installed as part of the press 20 so that the dies 38 can be repeatably aligned with the substrate. Specifically, with the dies 38 secured in the aligned position on the carrier plate 36, the die plate assembly 34 can be removed from the chase 32 and subsequently reinstalled so that all of the dies 38 are relocated as a group in the aligned position at the same time.

To initially locate the dies in the aligned position, the die adjusters 40 are configured to shift the die 38 from the misaligned position (e.g., see FIG. 8) to the aligned position (e.g., see FIG. 9). In the misaligned position, the die adjusters 40 are inserted into a pair of respective sockets 64, while a pair of nuts 52 are mounted on respective studs 50 associated with the other two (2) sockets 64.

Preferably, the pair of nuts 52 are brought into partial frictional engagement with the respective recessed faces 68, to allow lateral sliding of the die 38 relative to the carrier plate 36. With the nuts 52 being in partial frictional engagement, the die adjusters 40 are preferably rotated from the first position (see FIG. 8) to the second position (see FIG. 9) to cooperatively produce corresponding die movement from the misaligned position to the aligned position.

The nuts 52 are then threaded into full frictional engagement with the dies 38. In full frictional engagement, the nuts 52 cooperatively restrict lateral die movement out of the aligned position. In the illustrated embodiment, nuts 52 are preferably placed and secured on all of the studs 50, including the studs 50 from which the adjusters 40 have been removed. However, one or more dies 38 could be secured for use without fastening nuts on all of the studs.

Although the above description presents features of preferred embodiments of the present invention, other preferred embodiments may also be created in keeping with the principles of the invention. Such other preferred embodiments may, for instance, be provided with features drawn from one or more of the embodiments described above. Yet further, such other preferred embodiments may include features from multiple embodiments described above, particularly where such features are compatible for use together despite having been presented independently as part of separate embodiments in the above description.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention as set forth in the following claims.

What is claimed is:

1. A graphic arts die assembly comprising:
a die carrier plate;
a die adjustably supported on the die carrier plate,
said die presenting an outer margin and an engraved surface within the outer margin,
said die further presenting an adjuster surface positioned inboard of the outer margin and extending transversely relative to the engraved surface;
a die adjuster shiftably engaging the adjuster surface and operably supported relative to the die carrier plate, with shifting movement of the die adjuster along the die causing relative movement between the die and the die carrier plate,
said die presenting a die opening that shiftably receives at least part of the die adjuster.

2. The graphic arts die assembly as claimed in claim 1, said die adjuster being rotatably supported relative to the die carrier plate.

3. The graphic arts die assembly as claimed in claim 2, further comprising:
a stud fixed to the die carrier plate,
said die adjuster rotatably received on the stud and slidably engaging the adjuster surface as the die adjuster is rotated on the stud.

4. The graphic arts die assembly as claimed in claim 1, said adjuster surface extending about and defining the die opening.

5. The graphic arts die assembly as claimed in claim 4, said adjuster being rotatably supported relative to the die carrier plate.

6. The graphic arts die assembly as claimed in claim 5, further comprising:
a stud fixed to the die carrier plate and projecting into the die opening,
said die adjuster rotatably received on the stud and slidably engaging the adjuster surface as the die adjuster is rotated on the stud.

7. The graphic arts die assembly as claimed in claim 6, said die adjuster presenting an interior bore that rotatably receives the stud, said interior bore being unthreaded.

8. The graphic arts die assembly as claimed in claim 7, said die adjuster presenting a polygonal tool-engaging surface that circumscribes the interior bore.

9. The graphic arts die assembly as claimed in claim 7, said stud and interior bore being circular and concentric, said die adjuster presenting a cam surface that projects eccentrically relative to the interior bore to slidably engage the adjuster surface as the die adjuster is rotated on the stud.

10. A graphic arts die assembly comprising:
a die carrier plate;
a die adjustably supported on the die carrier plate,
said die presenting an outer margin and an engraved surface within the outer margin,
said die further presenting an adjuster surface positioned inboard of the outer margin and extending transversely relative to the engraved surface;
a die adjuster shiftably engaging the adjuster surface and operably supported relative to the die carrier plate, with shifting movement of the die adjuster along the die causing relative movement between the die and the die carrier plate,
said die adjuster being rotatably supported relative to the die carrier plate; and
a stud fixed to the die carrier plate,
said die adjuster rotatably received on the stud and slidably engaging the adjuster surface as the die adjuster is rotated on the stud,
said die adjuster presenting an interior bore that rotatably receives the stud, said interior bore being unthreaded.

11. A graphic arts die assembly comprising:
a die carrier plate;
a stud fixed to and projecting from the die carrier plate;
a die adjustably supported on the die carrier plate,
said die presenting an outer margin and an engraved surface within the outer margin,
said die further presenting an adjuster surface extending transversely relative to the engraved surface; and
a die adjuster removably and shiftably attached to the stud to shiftably engage the adjuster surface, with relative shifting of the die adjuster on the stud causing relative movement between the die and the die carrier plate, said die adjuster being rotatably received on the stud and slidably engaging the adjuster surface as the die adjuster is rotated on the stud, said die adjuster presenting an interior bore that rotatably receives the stud, said interior bore being unthreaded.

12. A graphic arts die assembly comprising:

a die carrier plate;

a stud fixed to and projecting from the die carrier plate;

a die adjustably supported on the die carrier plate, said die presenting an outer margin and an engraved surface within the outer margin, said die further presenting an adjuster surface extending transversely relative to the engraved surface; and a die adjuster removably and shiftably attached to the stud to shiftably engage the adjuster surface, with relative shifting of the die adjuster on the stud causing relative movement between the die and the die carrier plate, said die presenting a die opening that shiftably receives at least part of the die adjuster.

13. The graphic arts die assembly as claimed in claim 12, said adjuster surface extending about and defining the die opening.

14. The graphic arts die assembly as claimed in claim 13, said adjuster being rotatably received on the stud and slidably engaging the adjuster surface as the die adjuster is rotated on the stud.

15. The graphic arts die assembly as claimed in claim 14, said die adjuster presenting an interior bore that rotatably receives the stud, said interior bore being unthreaded.

16. The graphic arts die assembly as claimed in claim 15, said die adjuster presenting a polygonal tool-engaging surface that circumscribes the interior bore.

17. The graphic arts die assembly as claimed in claim 15, said stud and interior bore being circular and concentric, said die adjuster presenting a cam surface that projects eccentrically relative to the interior bore to slidably engage the adjuster surface as the die adjuster is rotated on the stud.

18. The graphic arts die assembly as claimed in claim 12, said die adjuster being rotatably received on the stud and slidably engaging the adjuster surface as the die adjuster is rotated on the stud.

19. The graphic arts die assembly as claimed in claim 12, said adjuster surface being positioned inboard of the outer margin.

* * * * *